US010236644B2

(12) United States Patent
Xu et al.

(10) Patent No.: US 10,236,644 B2
(45) Date of Patent: Mar. 19, 2019

(54) BUCKLE-TYPE LAMP HOLDER

(71) Applicant: Ningbo Yamao Optoelectronics Co., Ltd., Zhejiang (CN)

(72) Inventors: Qili Xu, Zhejiang (CN); Hu Fang, Zhejiang (CN); Yinyong Zhou, Zhejiang (CN)

(73) Assignee: NINGBO YAMAO OPTOELECTRONICS CO., LTD., Zhenjiang (CN)

( * ) Notice: Subject to any disclaimer, the term of this patent is extended or adjusted under 35 U.S.C. 154(b) by 0 days.

(21) Appl. No.: 15/710,253

(22) Filed: Sep. 20, 2017

(65) Prior Publication Data

US 2018/0202635 A1 Jul. 19, 2018

(30) Foreign Application Priority Data

Jan. 13, 2017 (CN) ..... 2017 1 0026231

(51) Int. Cl.
*H01R 24/00* (2011.01)
*F21V 19/04* (2006.01)
*H01R 33/06* (2006.01)

(52) U.S. Cl.
CPC ..... *H01R 24/005* (2013.01); *F21V 19/04* (2013.01); *H01R 33/06* (2013.01)

(58) Field of Classification Search
None
See application file for complete search history.

(56) References Cited

U.S. PATENT DOCUMENTS 5,422,487 A * 6/1995 Sauska ..... C02F 1/325 250/436

* cited by examiner

*Primary Examiner* — Sean P Gramling
(74) *Attorney, Agent, or Firm* — Andrew F. Young, Esq.; Lackenbach Siegel, LLP

(57) ABSTRACT

The invention provides a buckle-type lamp holder, which is in the field of lamps manufacturing technology. A buckle-type lamp holder includes a lamp connector and a power input connector arranged correspondingly, wherein the lamp connector is arranged with a metal connector and the power input connector is arranged with a corresponding electric groove, in which a metal contact sheet is arranged to electrify with the metal connector; according to the invention, the metal connector is arranged in a "T" shape, and a cross section of the electric groove is arranged in a "⊥" shape, so that the fixation effect is better by the combination of both; the electric groove is arranged in an arc shape and is centrosymmetric, to ensure that the installation process can be completed by rotating a certain angle and the installation process is more convenient, which reduces the cost effectively.

7 Claims, 3 Drawing Sheets

BUCKLE-TYPE LAMP HOLDER

CROSS-REFERENCE TO RELATED APPLICATIONS

The present application claims priority to and the benefit of Chinese Patent Application No. CN 201710026231.3, filed on Jan. 13, 2017, the entire content of which is incorporated herein by reference.

BACKGROUND OF THE INVENTION

1. Field of the Invention

The invention relates to the field of lamp manufacturing technology, more specifically, to a buckle-type lamp holder.

2. Description of the Related Art

Lamps have become an important part of our daily life, and become necessary lighting tools. Therefore, people pay more and more attention to lamps.

At present, there's a spiral connection method which is widely used in the connection method of lamps, wherein a male thread structure arranged on a lamp connector is cooperated with a corresponding female thread arranged on a connecting end of the power supply, which achieves the tight connection between the lamp connector and the connecting end of the power supply for power transmission. Moreover, the internal diameter size of a female thread generally includes 14 mm, 17 mm, 26 mm and 39 mm, but the inside diameter of such female thread is bigger than that of an adult finger, which may easily cause a risk of electric shock by false touch and cause safety accidents without cutting off the power.

Further, the lamps connected by such spiral connection method need to be rotated many times during installation to ensure that the power supply and the lamp connector are mounted in place, which causes a cumbersome installation process of lamps and increases additional labor, thereby increasing the installation costs.

In summary, the connection method of lamps currently has the disadvantages of low security, complicated installation process and high installation cost.

SUMMARY OF THE INVENTION

For the above mentioned deficiencies of the prior art, the present invention provides a buckle-type lamp holder, by arranging the mutually coordinated connectors on the lamp and the power input and arranging the connector of the power input in the groove to improve the ability of security protection, and the lamp can be fixed on the power input and connected by only rotating the lamp and the power input a certain angle so that the installation process is more convenient, which reduces the cost effectively.

The invention utilizes the following technical scheme.

A buckle-type lamp holder comprising: a lamp connector and a power input connector, wherein said lamp connector is arranged correspondingly to said power input connector, and one end of said lamp connector close to said power input connector is arranged in a column shape, a top end of said lamp connector is symmetrically arranged with two metal connectors, both said metal connectors are all arranged along an axial direction of said lamp connector, one end of said power input connector close to said lamp connector is arranged with a protective groove, and a groove bottom of said protective groove is arranged two centrosymmetric electric grooves, said electric groove is arranged in an arc shape, a distance between the two electric grooves is equal to a distance between the two metal connectors, and the two metal connectors can be inserted into the two electric grooves and rotate along the are shape of the electric groove.

A buckle-type lamp holder said above, wherein a side shape of the metal connector is arranged with a "T" shape, the metal connector comprises two sections of ladder-shaped columns, the column with a small cross section in the metal connector is fixed on the lamp connector, and the column with the large cross section is fixed on an end of the column with small cross section deviated from the lamp connector.

A buckle-type lamp holder said above, wherein a longitudinal cross section of said electric groove is arranged in a "⊥" shape, and a groove width of one end of said electric groove away from said lamp connector is larger than a groove width of another end of said electric groove close to said lamp connector.

A buckle-type lamp holder said above, wherein each said electric groove is arranged with a circular hole, two said circular hole being arranged centrosymmetricly, and the inner diameter of said circular hole equals to the groove width of the end of said electric groove away from said lamp connector.

A buckle-type lamp holder said above, wherein the inner diameter of said circular hole also equals to a diameter of said column with a large cross section on the metal connector.

A buckle-type lamp holder said above, wherein said lamp connector is one or multiple kinds of insulating piece from plastics, ceramics, and glass.

A buckle-type lamp holder said above, wherein two metal connectors are connected to the input of the lamp through a wire.

A buckle-type lamp holder said above, wherein a region of each the electric groove with the wide groove width is arranged with a metal contact sheet arranged in a region of the electric groove which is not the circular hole region.

A buckle-type lamp holder said above, wherein said power input connector is made of one or more materials of ceramic and plastic.

A buckle-type lamp holder said above, wherein said metal contact sheet is an elastic member, the elastic member is connected to a safety device, and to the power input through said safety device.

The beneficial effects of the present invention are as follows:

1. By arranging the lamp connector and the corresponding power input connector for fixation and electrifying, the structure is more simple; 2. by arranging the metal connector to the electric connector, and arranging the metal connector in a "T" shape and the electric groove in a "⊥" shape, the connection is securer and the security is higher; 3. the front end of two electric grooves is arranged with a circular hole, and the electric groove is arranged in an arc shape, so that after the lamp is rotated with a certain angle, the lamp connector can be fixed in the power input connector, to prevent the security risks from the separation of the two parts during the use, thereby the installation process is simplified and the cost is reduced; 4. a protective groove is arranged on the power input connector, so that after the lamp connector is installed and fixed, the protective groove can completely cover the lamp connector, thereby improving the safety performance; 5. by arranging an electric groove, and arranging a charged metal contact sheet in the electric groove, to effectively prevent the human body from accidentally touch and electric shock, and the metal contact sheet is connected with the safety device, so as to effectively improve the safety of the joint.

BRIEF DESCRIPTIONS OF THE DRAWINGS

The accompanying drawings, together with the specification, illustrate exemplary embodiments of the present disclosure, and, together with the description, serve to explain the principles of the present invention.

Figure 1:
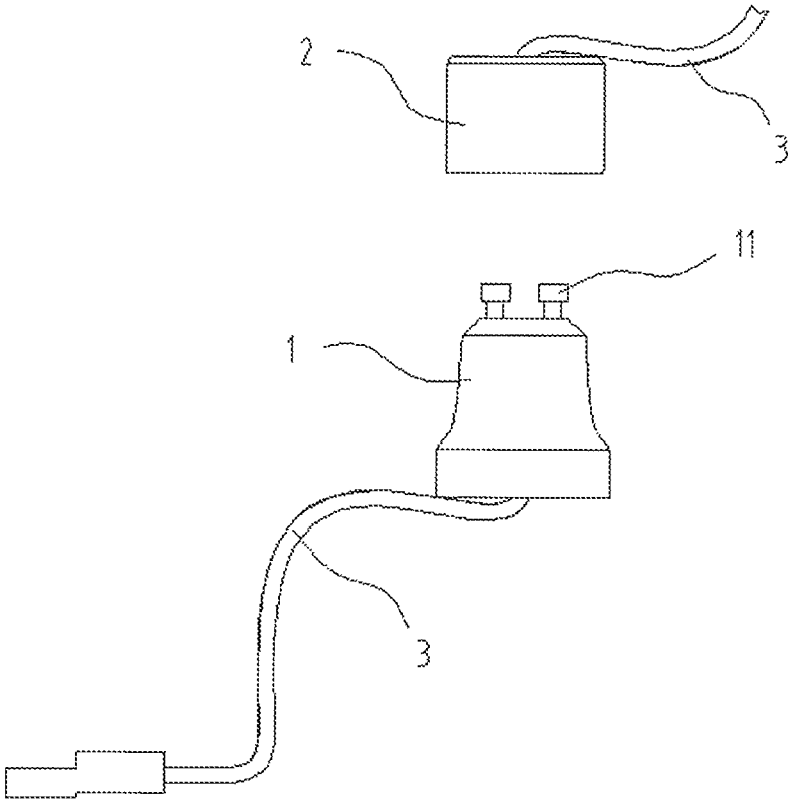
FIG. 1 is a structure diagram of an embodiment of a buckle-type lamp holder of the present invention.

The following call out list of elements can be a useful guide in referencing the element numbers of the drawings.

1. lamp connector; 11. metal connector; 111. a column with a large cross section; 112. a column with a small cross section; 2. power input connector; 21. protective groove; 22. electric groove; 23. metal contact sheet; 221. circular hole; 3. wire.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the term "plurality" means a number greater than one.

Hereinafter, certain exemplary embodiments according to the present disclosure will be described with reference to the accompanying drawings.

The present invention will now be described more fully hereinafter with reference to the accompanying drawings 1-5, in which exemplary embodiments of the invention are shown. This invention may, however, be embodied in many different forms and should not be construed as limited to the embodiments set forth herein.

Figure 2:
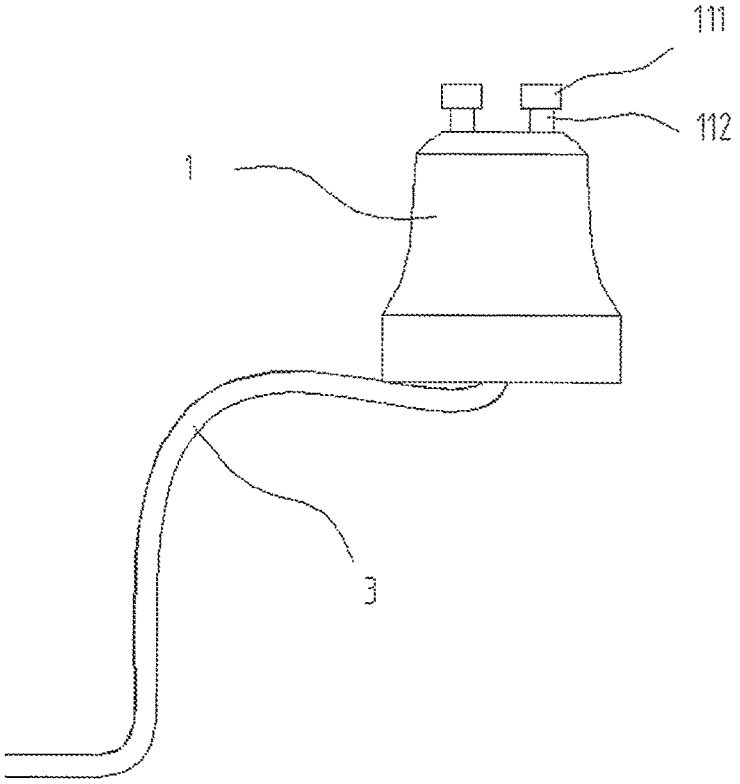
FIG. 2 is a structure diagram of a view of a better embodiment of a lamp connector of the present invention.
Figure 3:
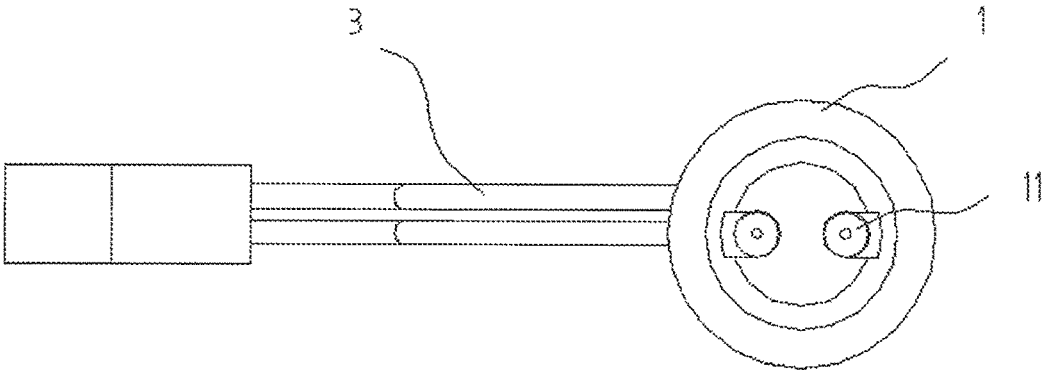
FIG. 3 is a structure diagram of another view of a better embodiment of a lamp connector of the present invention.
Figure 4:
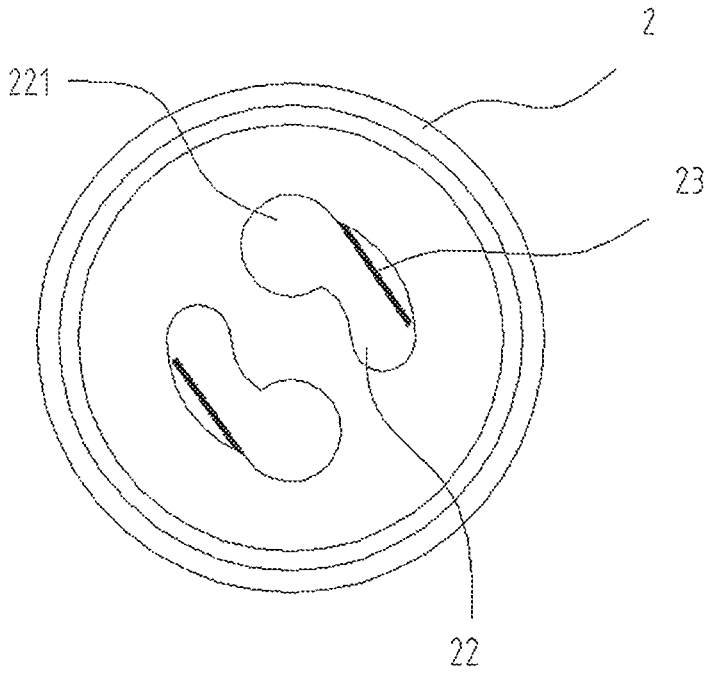
FIG. 4 is a structure diagram of a view of a better embodiment of a power input connector of the present invention.
Figure 5:
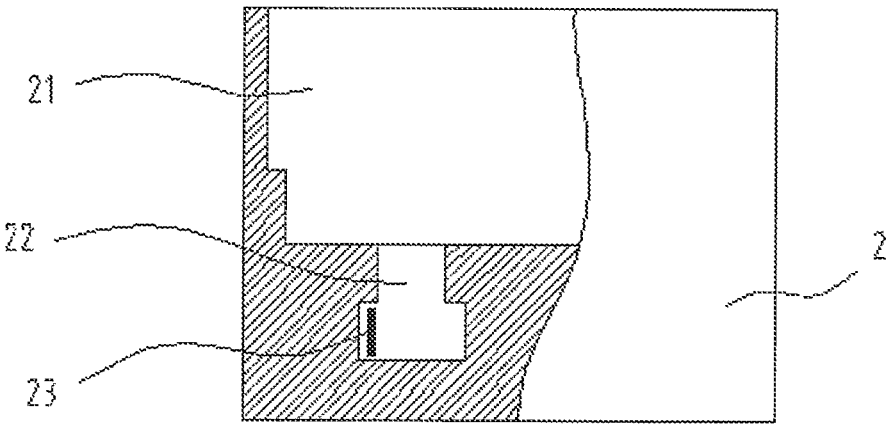
FIG. 5 is a half sectional view of a better embodiment of a power input connector of the present invention.

FIG. 1 is a structure diagram of an embodiment of a buckle-type lamp holder of the present invention; FIG. 2 is a structure diagram of a view of a better embodiment of the lamp connector of the present invention; FIG. 3 is a structure diagram of another view of the better embodiment of the lamp connector of the present invention; FIG. 4 is a structure diagram of the view of the better embodiment of the power input connector of the present invention; FIG. 5 is a half sectional view of the better embodiment of the power input connector of the present invention. As shown in FIGS. 1, 2, 3, 4 and 5, the present embodiment provides a buckle-type lamp holder comprising: a lamp connector 1, metal connectors 11, columns with a large cross section 111, columns with a small cross section 112, a power input connector 2, a protective groove 21, electric grooves 22, metal contact sheets 23, circular holes 221 and wires 3.

Particularly, the lamp is connected to the lamp connector 1 through wires 3, the power source is connected to a power input connector 2 through the wires 3, and the lamp connector 1 is configured correspondingly to the power input connector 2.

Particularly, one end of the lamp connector 1 close to the power input connector 2 is arranged in a column shape, and the top end of the end of the lamp connector 1 is arranged with two metal connectors 11, wherein both the two metal connectors 11 are configured symmetrically and both arranged along the axial direction of the lamp connector 1.

Particularly, the side shape of the metal connector 11 is arranged in a "T" shape, and each metal connector 11 includes two sections of ladder-shaped columns, wherein the column with the small cross section 112 is fixed on the lamp connector 1, and the column with the large cross section 111 is fixed on the end of the column with the small cross section 112 away from the lamp connector 1, which facilitates the fixation and electrifying of the metal connector 11.

Particularly, one end of the power input connector 2 close to the lamp connector 1 is arranged with a circular protective groove 21, wherein the size of the protective groove 21 is the same as the size of the column of one end of the lamp connector 1 close to the power input connector 2, to ensure the protecting effects after the lamp connector 1 is connected with the power input connector 2, to prevent leakage or accident touch, thereby the safety is improved.

Particularly, two electric grooves 22 are arranged at the bottom of the protective groove 21 on the power input connector 2, the two electric grooves 22 are arranged in an arc shape, the distance between the two electric grooves 22 is equal to the distance between the two metal connectors 11, and the two electric grooves 22 are arranged centrosymmetricly. Moreover, the axial direction of the power input connector 2 is the direction of the groove depth of the electric groove 22.

The cross section of the electric groove 22 is arranged in a "⊥" shape, the groove width of one end of the electric groove 22 away from the lamp connector 1 is larger than the groove width of another end of the electric groove 22 close to the lamp connector 1, and the groove width of one end of the electric groove 22 away from the lamp connector 1 equals to the diameter of the column with the large cross section 111 of the metal connector 11 of the lamp connector 1, and the groove width of one end of the electric groove 22 close to the lamp connector 1 equals to the diameter of the column with the small cross section 112 of the metal connector 11 of the lamp connector 1, ensuring that the metal connector 11 can be fixed to the electric groove 22 so as to prevent the lamp connector 1 from being disengaged from the power input connector 2, thereby effectively improving the safety.

More particularly, the front ends of the two electric grooves 22 are separately arranged with a circular hole 221, the two circular holes 221 are arranged centrosymmetricly and arranged along the direction of the groove depth of the electric groove 22, and the inner diameter of the circular hole 221 equals to the diameter of the column with the large cross section 111 of the metal connector 11, and the groove width of one end of the electric groove 22 away from the lamp connector 1.

More particularly, the length of the are in the two electric grooves 22 is of the range of ¼ to ½ circles, preferably a length of 5/18 circles, which is facilitates to effectively fixedly connect the lamp connector 1 to the power input connector 2, to reduce the rotation distance, to simplify the installation process of the lamp, and to reduce the labor hour, thereby reducing the installation cost.

More particularly, each electric groove 22 is arranged with a metal contact sheet 23 inside, and the wide region of the groove width of each electric groove 22 is arranged with the metal contact sheet 23, the metal contact sheet 23 is arranged in a region of the electric groove 22 which is not the circular hole 221 region. The metal contact sheet 23 is made of elastic piece, to ensure that the metal connector 11 is always connected to the metal contact sheet 23 during the rotation of the lamp connector 1, which improves the stability of electrifying and prevents users from accidental contacting with the charged metal contact sheets 23, so that the security is better.

One end of the lamp connector 1 with the metal connector 11 is inserted into the protective groove 2 of the power input connector 2, and the two metal connectors 11 are respectively inserted into the circular holes 221 in the two electric grooves 22, then the two metal connectors 11 rotate around the circular arc of the electric groove 22 by rotating the lamp connector 1, at this time, the column with the large section 111 on the metal connector 11 slips in the wide region of the groove width of the electric groove 22 and contacts with the metal contact sheet 23, and the column with the small section 112 on the metal connector 11 slips in the narrow region of the groove width of the electric groove 22. After the rotation is in place, the lamp connector 1 is fixed relatively to the power input connector 2, and the metal connector 11 is brought into contact with the metal contact sheet 23 and electrified, and the entire process is carried out in the protection groove 21, thereby effectively improving the safety.

More particularly, each metal contact sheet 23 is connected with a safety device thereon, and it connects to the power input through the safety device, to make sure to cut off the circuit automatically in case of emergency, thereby improving the safety performance.

More particularly, the lamp connector 1 is one or more insulating piece from plastics, ceramics, and glass; the power input connector 2 is made of one or more materials from ceramic and plastic. This can effectively prevent leakage of electricity and make security higher.

The present invention arranges a buckle-type lamp holder, includes a lamp connector 1 and a power input connector 2 arranged correspondingly, wherein the lamp connector 1 is arranged with a metal connector 11 thereon, and the power input connector 2 is arranged with a corresponding electric groove 22 thereon, and in the electric groove 22 a metal contact sheet 23 is arranged to electrify with the metal connector 11; by arranging the metal connector 11 in a "T" shape, and the electric groove 22 in a cross section "⊥" shape, so that the fixation effect is better by the combination of both; the electric groove 22 is arranged in an arc shape and is centrosymmetric, ensuring that the installation process can be completed by only rotating a certain angle and the installation process is more convenient, which reduces the cost effectively; a charged metal contact sheet 23 is arranged in the electric groove 22, thereby reducing the risk of electric shock when the hand is accidentally touched, which shows higher security.

The foregoing is only the preferred embodiments of the invention, not thus limiting embodiments and scope of the invention, those skilled in the art should be able to realize that the schemes obtained from the content of specification and figures of the invention are within the scope of the invention.

What is claimed is:

1. A buckle-type lamp holder, comprising:

a lamp connector and a power input connector, wherein the lamp connector is arranged correspondingly to the power input connector, one end of the lamp connector close to the power input connector is arranged in a column shape, a top end of the lamp connector is symmetrically arranged with two metal connectors, both the two metal connectors are arranged along an axial direction of the lamp connector, one end of the power input connector close to the lamp connector is arranged with a protective groove, a groove bottom of the protective groove is arranged with two centrosymmetric electric grooves, the electric groove is arranged in an arc shape, a distance between the two electric grooves is equal to a distance between the two metal connectors, and the two metal connectors can be inserted into the two electric grooves and rotate along the arc shape of the electric groove;

wherein a longitudinal cross section of the electric groove is arranged in a "⊥" shape, and a groove width of one end of the electric groove away from the lamp connector is larger than a groove width of another end of the electric groove close to the lamp connector; wherein a front end of each electric groove is arranged with a circular hole, two circular holes are arranged centrosymmetricly, and the inner diameter of the circular hole equals to the groove width of the end of the electric groove away from the lamp connector; wherein a region of each the electric groove with the wide groove width is arranged with a metal contact sheet arranged in a region of the electric groove which is not the circular hole region; wherein the metal contact sheet is an elastic member, the elastic member is connected to a safety device, and to the power input through the safety device.

2. The buckle-type lamp holder according to claim 1, wherein a side shape of the metal connector is arranged in a "T" shape, the metal connector comprises two sections of ladder-shaped columns, the column with a small cross section in the metal connector is fixed on the lamp connector, and the column with the large cross section is fixed on an end of the column with the small cross section away from the lamp connector.

3. The buckle-type lamp holder according to claim 2, wherein the inner diameter of the circular hole also equals to a diameter of the column with a large cross section on the metal connector.

4. The buckle-type lamp holder according to claim 1, wherein the inner diameter of the circular hole also equals to a diameter of the column with a large cross section on the metal connector.

5. The buckle-type lamp holder according to claim 1, wherein the lamp connector is one or multiple kinds of insulating piece from plastics, ceramics, and glass.

6. The buckle-type lamp holder according to claim 1, wherein two metal connectors are connected to the input of the lamp through a wire.

7. The buckle-type lamp holder according to claim 1, wherein the power input connector is made of one or more materials of ceramic and plastic.

* * * * *